US005984569A

United States Patent [19]

Chou

[11] Patent Number: 5,984,569

[45] Date of Patent: Nov. 16, 1999

[54] GATE BARRIER

[76] Inventor: Pi-Cheng Chou, 2F, No. 333-2, Sec. 2, Shih Pai Rd., Taipei, Taiwan

[21] Appl. No.: 09/037,272

[22] Filed: Mar. 9, 1998

[51] Int. Cl.[6] ..... E01F 13/06

[52] U.S. Cl. ..... 404/6; 14/53; 49/49; 49/334; 49/381

[58] Field of Search ..... 14/50, 52, 53; 404/6; 49/49, 334, 381; 256/1, 13.1

[56] References Cited

U.S. PATENT DOCUMENTS

| | | | |
|---|---|---|---|
| 859,489 | 1/1907 | Donovan | 14/53 X |
| 2,563,894 | 8/1951 | White . | |
| 2,807,107 | 9/1957 | Goulet . | |
| 4,519,164 | 5/1985 | Porter . | |
| 4,844,653 | 7/1989 | Dickinson | 404/6 |

*Primary Examiner*—James A. Lisehora
*Attorney, Agent, or Firm*—Rosenberg, Klein & Bilker

[57] ABSTRACT

A gate barrier which includes a first post, a drive shaft and a driven shaft revolvably supported on the first post at different elevations, a second post disposed in parallel to the first post, the second post having at least one angled holder plate, and a folding collapsible barrier having a fixed end fixedly connected to the drive shaft and the driven shaft and a free end for resting on the at least one holder plate at the second post, the folding collapsible barrier being extended out when lowered with its free end rested on the at least one angled holder plate at the second post, the folding collapsible barrier being collapsed when lifted from the second post to a vertical position in vertical alignment with the first post.

4 Claims, 6 Drawing Sheets

GATE BARRIER

BACKGROUND OF THE INVENTION

The present invention relates to a gate barrier installed in a gate for preventing people from passing, and more particularly to such a gate barrier which comprises a folding collapsible barrier, which is extended out when lowered to the operative position, or collapsed when lifted to the non-operative position.

In order to prevent people from passing through a gate, a gate barrier may be installed. FIG. 1 shows a conventional gate barrier for this purpose. The gate barrier is comprised of a first post 10 having an angled holder plate 11 near the top, a second post 15 disposed in parallel to the first post 10 and having an angled holder plate 11 near the top, and a rail 13 rested on the angled holder plates 11;17 between the posts 10;15. Because the rail 13 is not prominent, a car driver may neglect to stop the car, causing the rail 13 to be broken by the running car. Because the space between the posts 10;15 below the rail 13 is an open space, small animal may pass through the gate barrier. In order to prevent small animal from passing, a grating may be used and supported between the posts instead of the rail. However, it is inconvenient to frequently place the grating on the posts and then to take it away from the posts. Further, the grating occupies must ground space when it is removed from the posts.

SUMMARY OF THE INVENTION

The present invention has been accomplished to provide a gate barrier which eliminates the aforesaid problems. It is one object of the present invention to provide a gate barrier which effectively prevents people and small animal from passing. It is another object of the present invention to provide a gate barrier which is folding collapsible. To achieve these and other objects of the present invention, there is provided a gate barrier which is comprised of a first post, a drive shaft and a driven shaft revolvably supported on the first post at different elevations, a second post disposed in parallel to the first post, the second post having at least one angled holder plate, and a folding collapsible barrier having a fixed end fixedly connected to the drive shaft and the driven shaft and a free end for resting on the at least one holder plate at the second post. The folding collapsible barrier is comprised of a top rail, a bottom rail, and a plurality of links coupled between the top rail and the bottom rail. The folding collapsible barrier is extended out when it is lowered with its free end rested on the at least one angled holder plate at the second post. The folding collapsible barrier is collapsed when lifted from the second post to a vertical position in vertical alignment with the first post.

DETAILED DESCRIPTION OF THE PRESENT INVENTION

Figure 1:
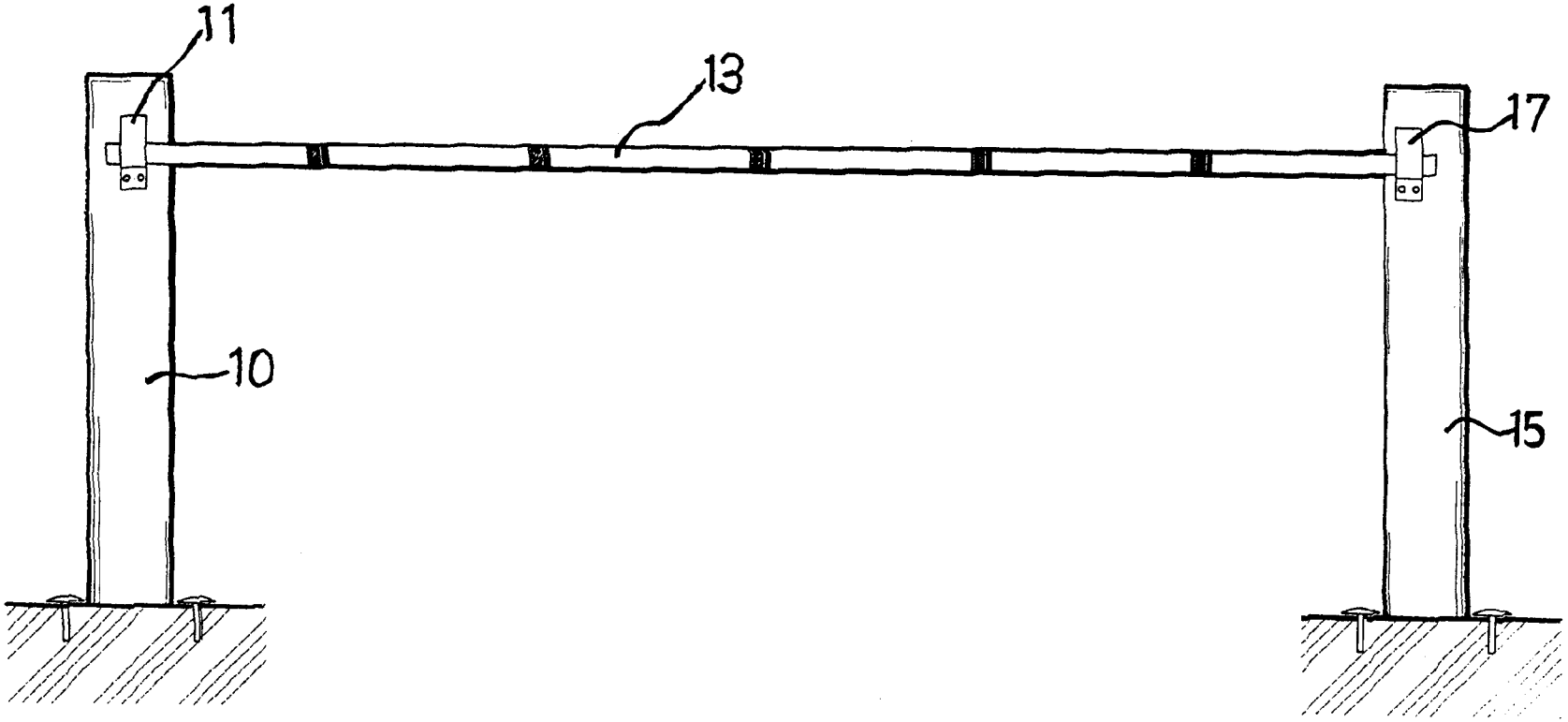
FIG. 1 Prior Art
FIG. 1 shows a conventional gate barrier.
Figures 2, 2A, 2B:
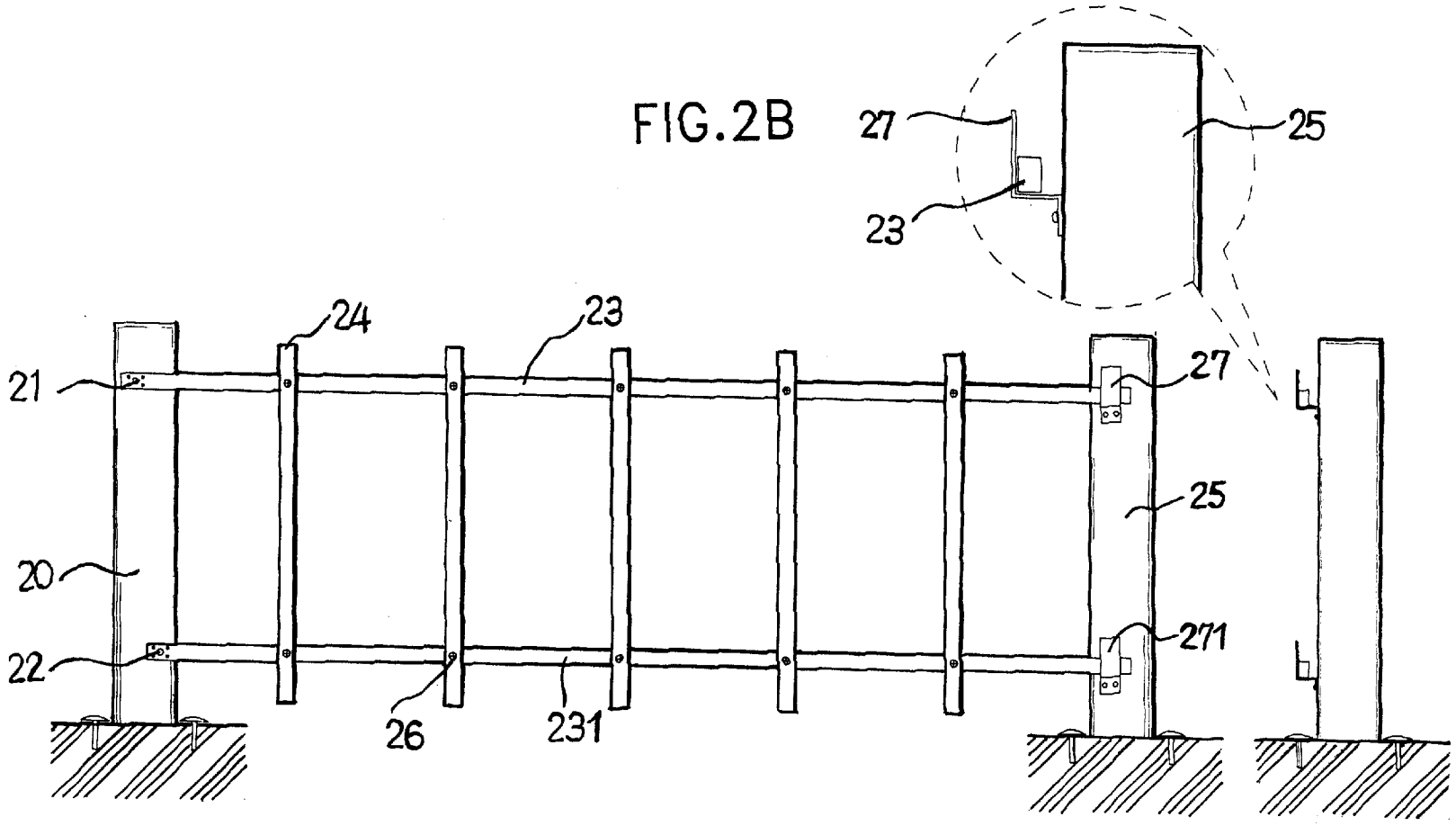
FIG. 2 is an elevational view of a gate barrier according to the present invention when closed.
FIG. 2A is a side view of FIG. 2.
FIG. 2B is an enlarged view of the upper part of FIG. 2.
Figures 3, 3A, 3B:
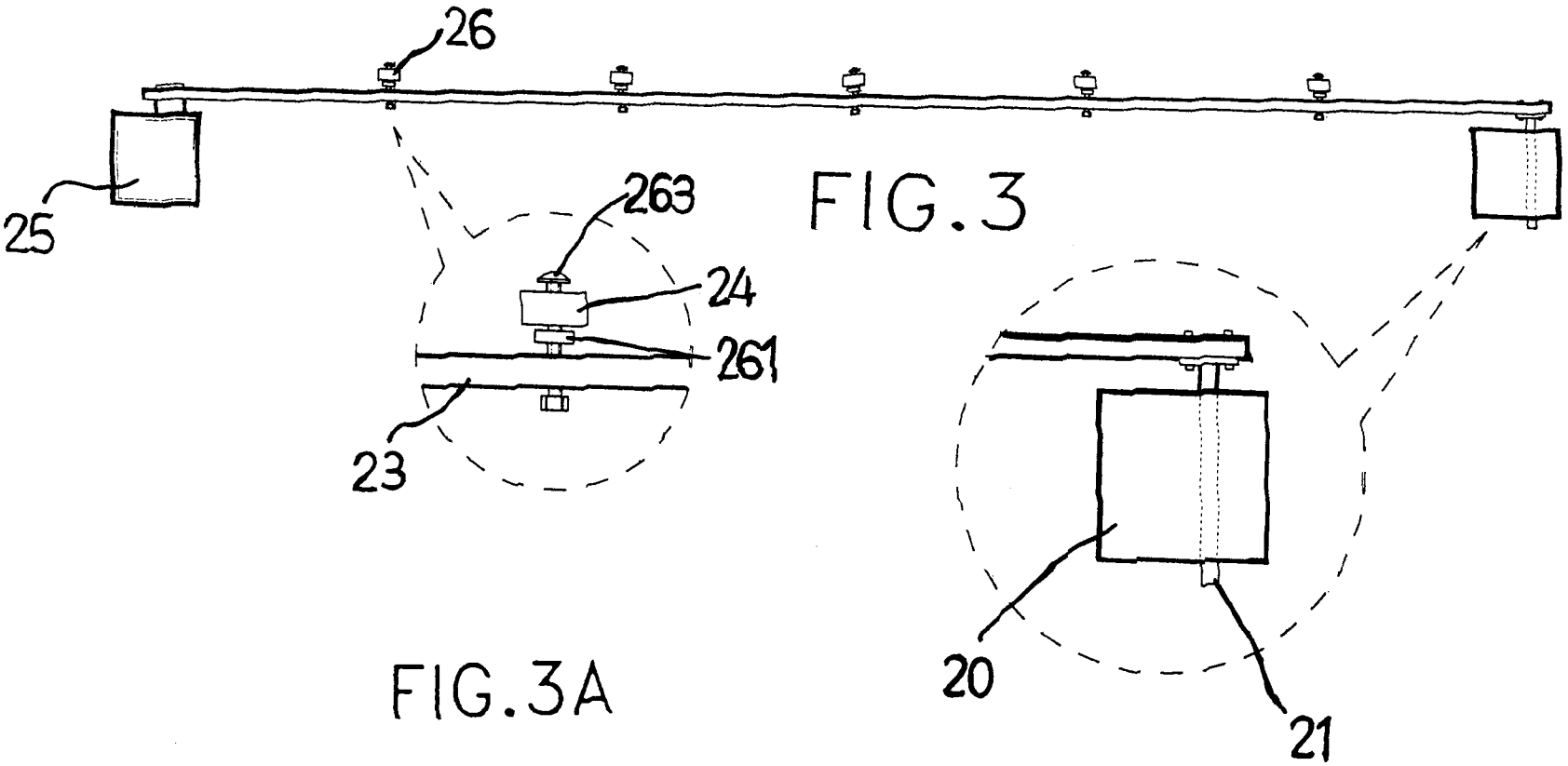
FIG. 3 is a top view of FIG. 2.
FIG. 3A is an enlarged view of a part of FIG. 3, showing the structure of the connecting device.
FIG. 3B is an enlarged view of a part of FIG. 3, showing the drive shaft installed in the first post.

Referring to FIGS. 2, 2A, 2B, 3A, 3B and FIG. 5, a gate barrier in accordance with the present invention is generally comprised of a first post 20, a second post 25, and a folding collapsible barrier mounted between the first post 20 and the second post 25 to prevent people from passing. A drive shaft 21 and a driven shaft 22 are revolvably supported on the first post 20 at different elevations. A first angled holder plate 27 and a second angled holder plate 271 are respectively provided at the second post 25 at different elevations corresponding to the shafts 21;22 at the first post 20. The folding collapsible barrier comprises a top rail 23, a bottom rail 23, and a plurality of links 24 respectively coupled between the top rail 23 and the bottom rail 23 by connecting devices 26. The top rail 23 has a fixed end fixedly connected a drive shaft 21 at the first post 29 (see FIG. 3B), and a free end. The bottom rail 241 has a fixed end fixedly connected to the driven shaft 22 at the first post 29, and a free end. The top rail 23 and the bottom rail 231 and be turned with the shafts 21;22 between a first position where the free ends of the top rail 23 and the bottom rail 231 are respectively rested on the angled holder plates 27;271 at the second post 25 (see FIG. 2), and a second position where the folding collapsible barrier is folded up (see FIG. 5) and supported on the first post 20 in vertical.

Referring to FIGS. 2 and 3A again, the connecting device 26 is comprised of a rivet 263 mounted in a hole (not shown) on the rail 23 or 231 and a hole (not shown) on one link 24, and a washer 261 mounted around the rivet 263 between the rail 23 or 231 and the corresponding link 24. Therefore, the rail 23 or 231 and the link 24 can be respectively turned about the rivet 263.

Figure 4:
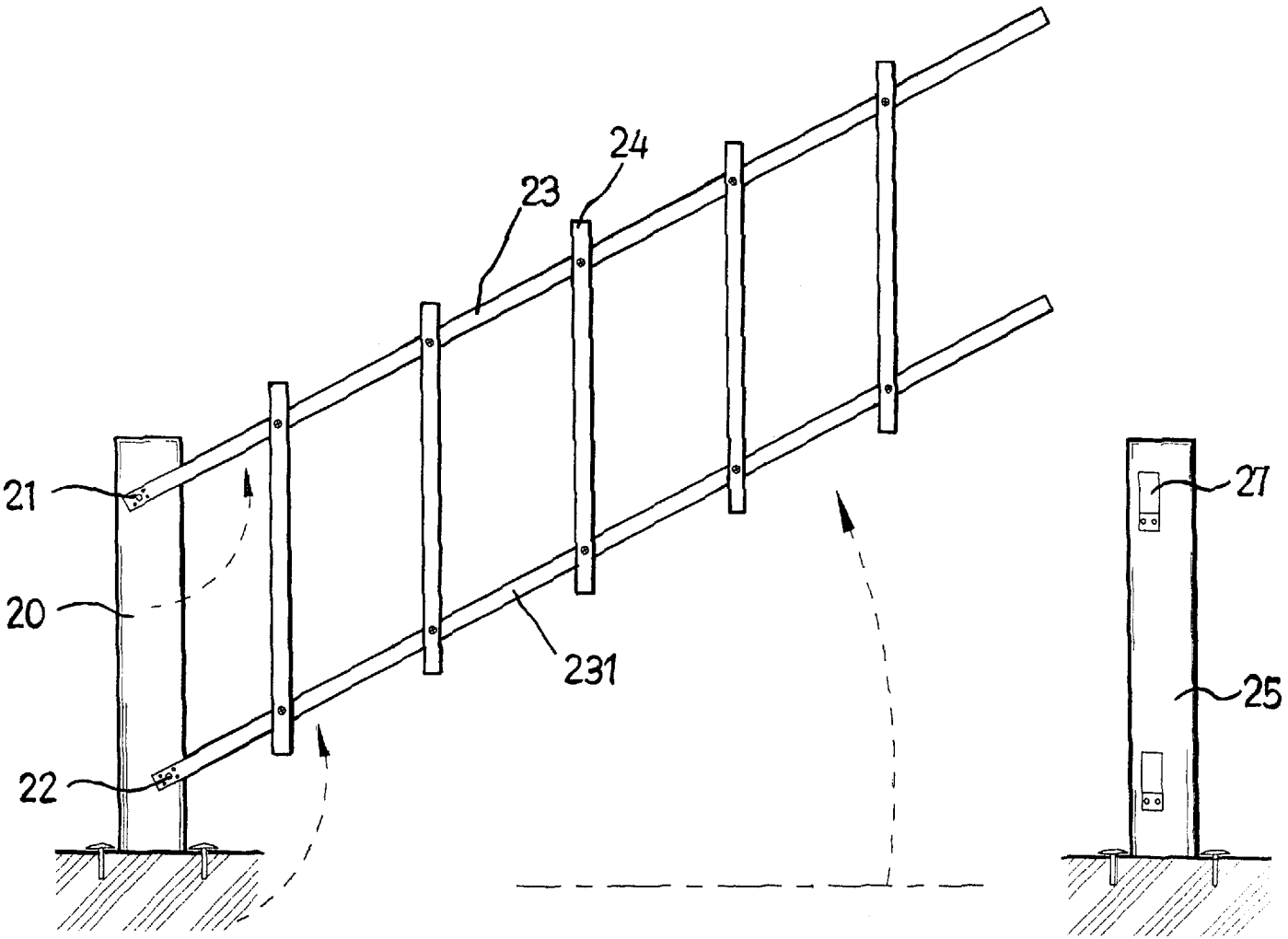
FIG. 4 is an applied view of the present invention, showing the top rail and the bottom rail of the folding collapsible barrier lifted from the angled holder plates at the second post.
Figure 5:
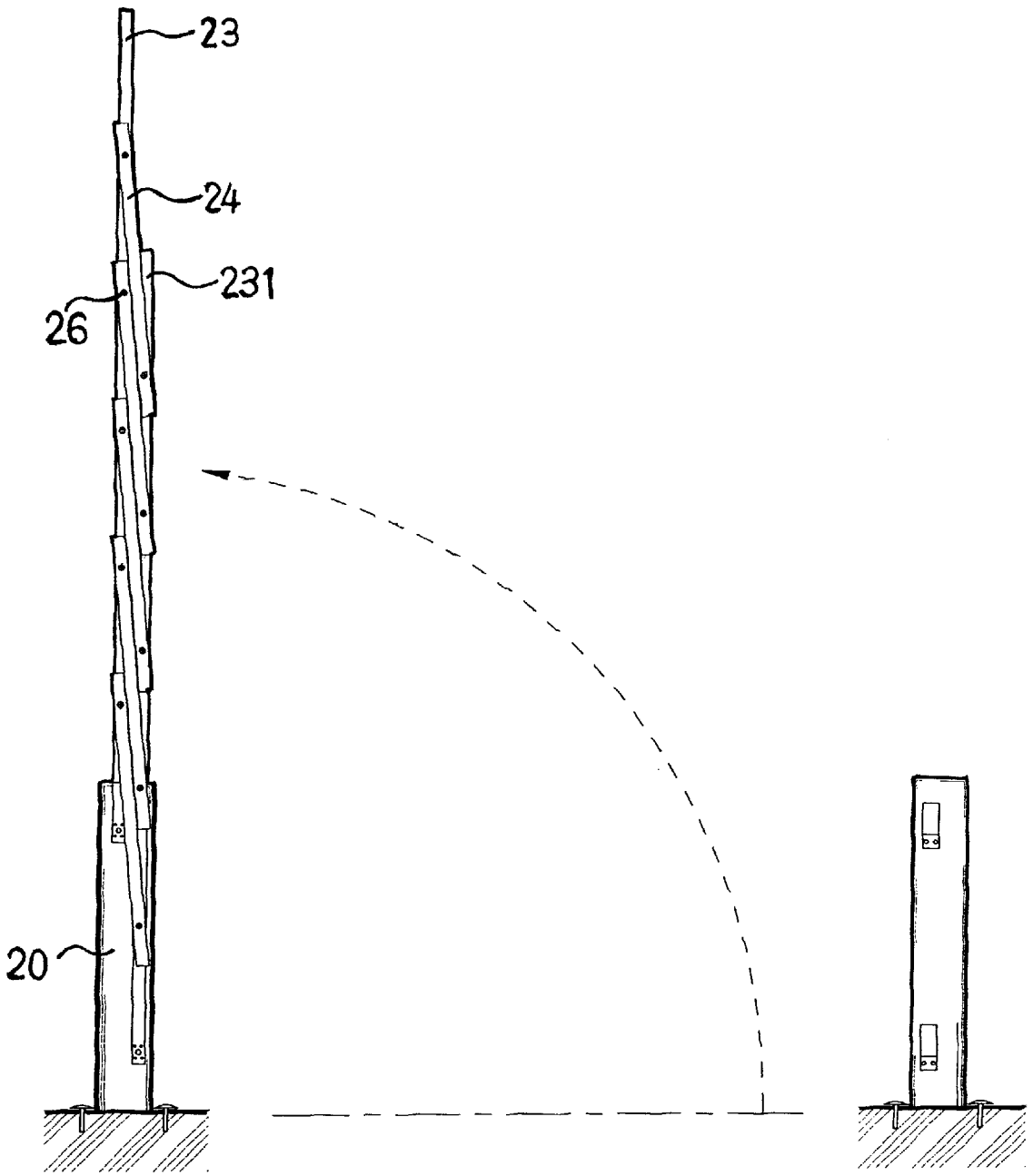
FIG. 5 shows the state wherein the folding collapsible barrier lifted to the vertical position in vertical alignment with the first post and collapsed according to the present invention.

Referring to FIG. 4 and FIGS. 2 and 5 again, when the drive shaft 21 is turned by for example a motor (not shown) in one direction, the top rail 23 and the bottom rail 231 are turned with the shafts 21;22 from a horizontal position shown in FIG. 2 to a vertical position shown in FIG. 5, and the free ends of the top rail 23 and the bottom rail 231 are respectively lifted from the angled holder plates 27;271. After the barrier has been lifted to the vertical position as shown in FIG. 5, the top rail 23, the bottom rail 231 and the links 24 are closely received together. On the contrary, when the drive shaft 21 is turned by the motor in the reversed direction, the free ends of the rails 23;231 are lowered and rested on the angled holder plates 27;271 to close the entrance.

Figure 6:
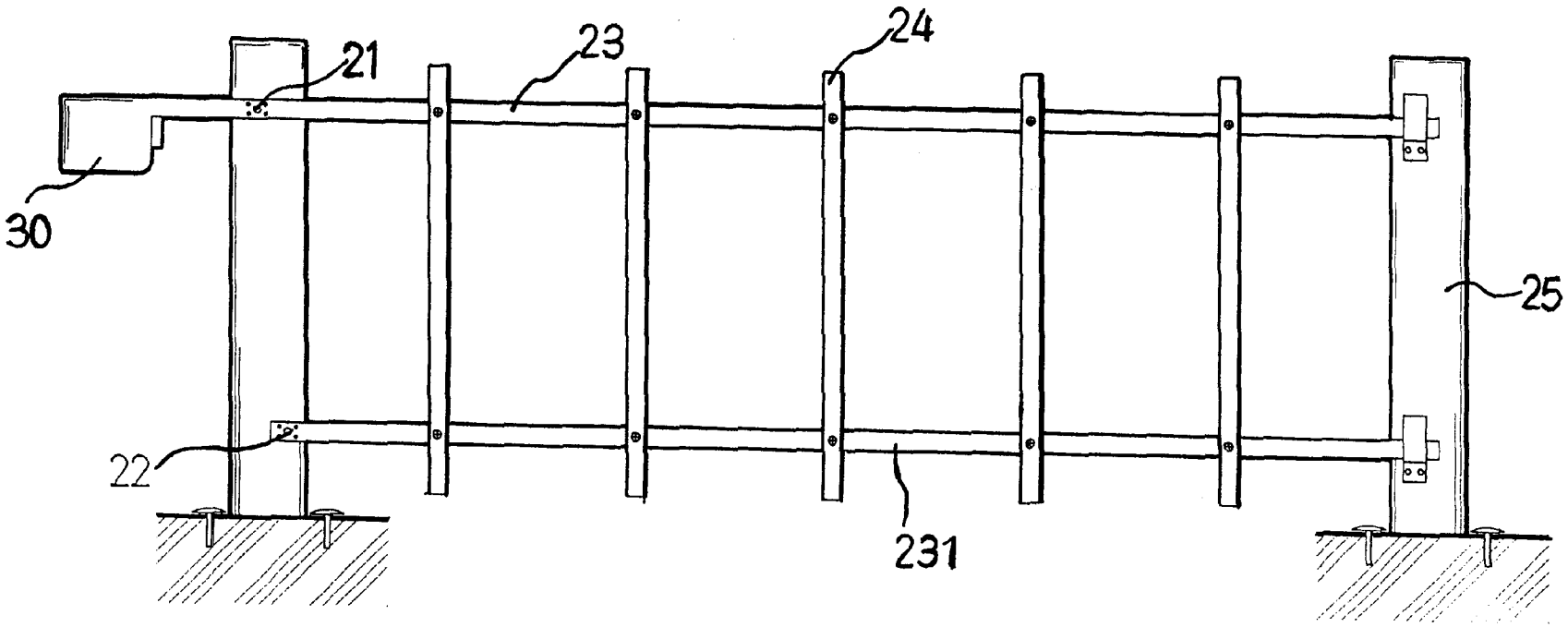
FIG. 6 is an elevational view of an alternate form of the gate barrier according to the present invention.

FIG. 6 shows an alternate form of the present invention. According to this alternate form, a handle 30 is connected to the fixed end of the top rail 23 for operation by hand to turn the barrier between the horizontal position and the vertical position.

It is to be understood that the drawings are designed for purposes of illustration only, and are not intended as a definition of the limits and scope of the invention disclosed, and various modifications and changes could be made thereunto without departing from the spirit and scope of the invention. For example a plurality of intermediate rails may be coupled to the links 24 between the top rail 23 and the bottom rail 231 by rivets.

What the invention claimed is:

1. A gate barrier comprising:

a first post;

a drive shaft and a driven shaft revolvably supported on said first post at different elevations;

a second post disposed in parallel to said first post, said second post having a first angled holder plate and a second angled holder plate at different elevations corresponding to said drive shaft and said driven shaft at said first post; and a folding collapsible barrier having a fixed end fixedly connected to said drive shaft and said driven shaft and a free end, said folding collapsible barrier comprising a top rail having a fixed end fixedly connected to said drive shaft and a free end for resting on said first angled holder plate, a bottom rail having a fixed end fixedly connected to said driven shaft and a free end for resting on said second angled holder plate, and a plurality of links coupled between said top rail and said bottom rail, the free ends of said top rail and said bottom rail being rested on said first angled holder plate and said second angled holder plate when said drive shaft is turned in one direction through a predetermined angle, said top rail and said bottom rail being lifted from said first angled holder plate and said second angled holder plate to a vertical position in vertical alignment with said first post and received with said links together when said drive shaft is turned in the reversed direction through 90° angle.

2. The gate barrier of claim 1, wherein said links are respectively connected to said top rail and said bottom rail by a plurality of connecting devices, each of said connecting devices comprising a rivet mounted in a hole on one of said top rail and said bottom rail and a hole on one of said links, and a washer mounted around the respective rivet between said top or bottom rail and the corresponding link.

3. The gate barrier of claim 1 further comprising a motor controlled to turn said drive shaft.

4. The gate barrier of claim 1 further comprising a handle fixedly connected to said drive shaft and the fixed end of said top rail for operation by hand.

* * * * *